US006453513B2

(12) United States Patent
Duda

(10) Patent No.: US 6,453,513 B2
(45) Date of Patent: Sep. 24, 2002

(54) APPARATUS FOR INTRODUCING SLIVER INTO A TEXTILE PROCESSING MACHINE

(75) Inventor: Günter Duda, Mönchengladbach (DE)

(73) Assignee: Trützschler GmbH & Co. KG, Mönchengladbach (DE)

( * ) Notice: Subject to any disclaimer, the term of this patent is extended or adjusted under 35 U.S.C. 154(b) by 47 days.

(21) Appl. No.: 09/900,163

(22) Filed: Jul. 9, 2001

Related U.S. Application Data

(63) Continuation of application No. 09/775,810, filed on Feb. 5, 2001.

(30) Foreign Application Priority Data

Feb. 3, 2000 (DE) ..... 100 04 604

(51) Int. Cl.[7] ..... D01H 5/00
(52) U.S. Cl. ..... 19/236; 19/150; 19/157
(58) Field of Search ..... 19/0.25, 65 A, 19/150, 157, 235–240, 258, 260, 271, 293, 159 A, 159 R; 57/281, 315; 226/188, 190; 492/10, 16; 29/895

(56) References Cited

U.S. PATENT DOCUMENTS 4,065,831 A * 1/1978 Huntsinger ..... 19/0.25
4,443,913 A * 4/1984 Klazar ..... 19/159 A
4,703,431 A * 10/1987 Sako et al.
5,161,284 A * 11/1992 Leifeld ..... 19/260
5,299,343 A * 4/1994 Tomoto et al. ..... 19/157
6,170,125 B1 * 1/2001 Steinert et al. ..... 19/236

FOREIGN PATENT DOCUMENTS

| | | | |
|---|---|---|---|
| DE | 39 24 208 | * | 1/1991 |
| DE | 44 24 490 | * | 1/1996 |
| DE | 198 09 875 | * | 9/1999 |
| EP | 0 978 581 | * | 2/2000 |
| GB | 2 335 205 | * | 9/1999 |
| JP | 8-35132 | * | 6/1996 |
| WO | 99/58749 | * | 11/1999 |

* cited by examiner

*Primary Examiner*—Danny Worrell
*Assistant Examiner*—Gary L. Welch
(74) *Attorney, Agent, or Firm*—Venable; Gabor J. Kelemen

(57) ABSTRACT

An apparatus for introducing a plurality of slivers simultaneously to a sliver processing machine includes an arrangement for withdrawing the slivers from coiler cans; a creel; a plurality of supply rolls mounted on the creel and contacting the slivers; a drive, having at least one drive motor, for rotating each supply roll; a common converter connected to the drive; and an rpm setter for setting rpm's of the drive such that the drive has an rpm essentially corresponding to a desired rpm.

16 Claims, 4 Drawing Sheets

4
11
3
7'
2
12
13
8c
D
9c
C
17c
10c
7c
5c
19
1
8b
9b
17b
18
A
10b
7b
5b
8a
9a
17a
10a
5a
6
7a
B

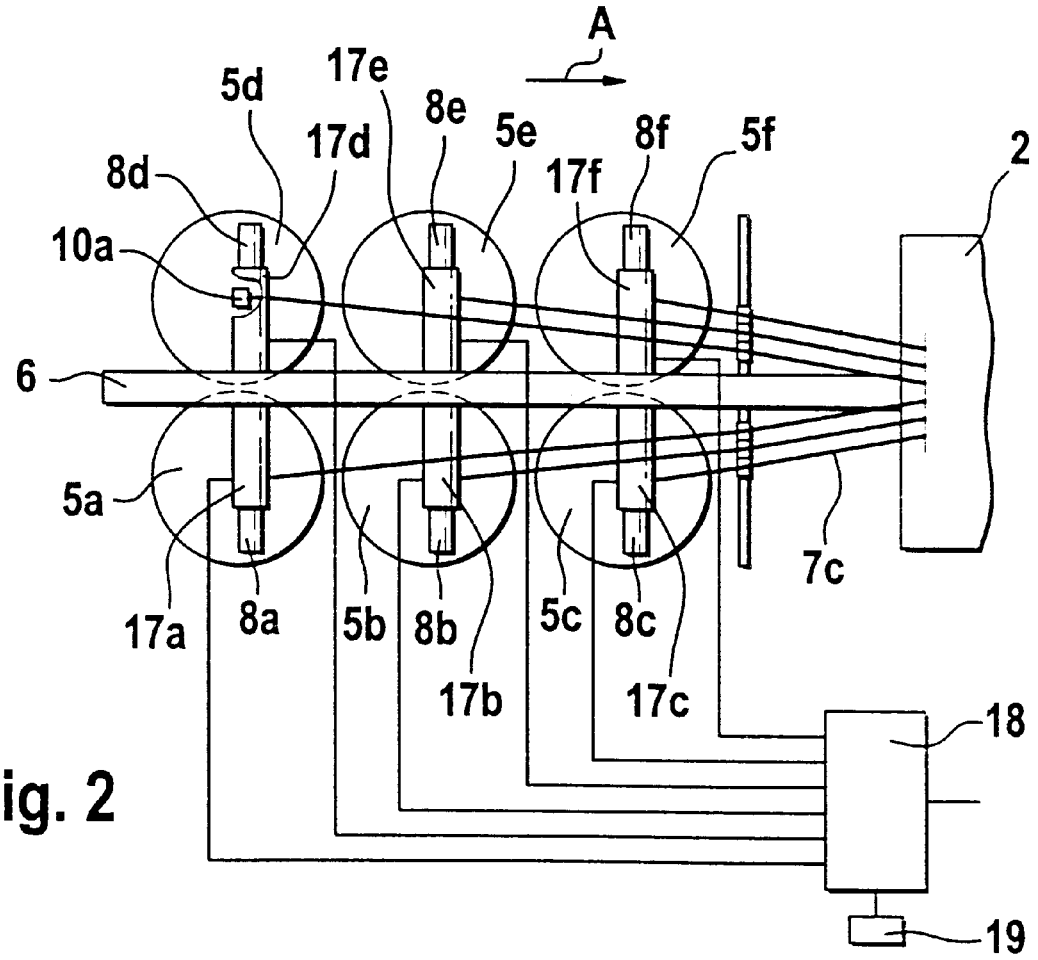
Fig. 2
Fig. 3
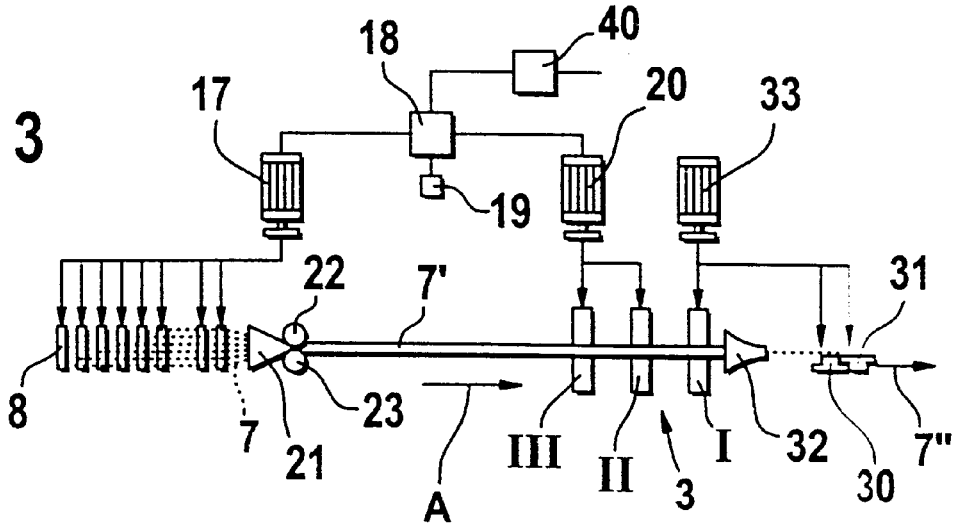

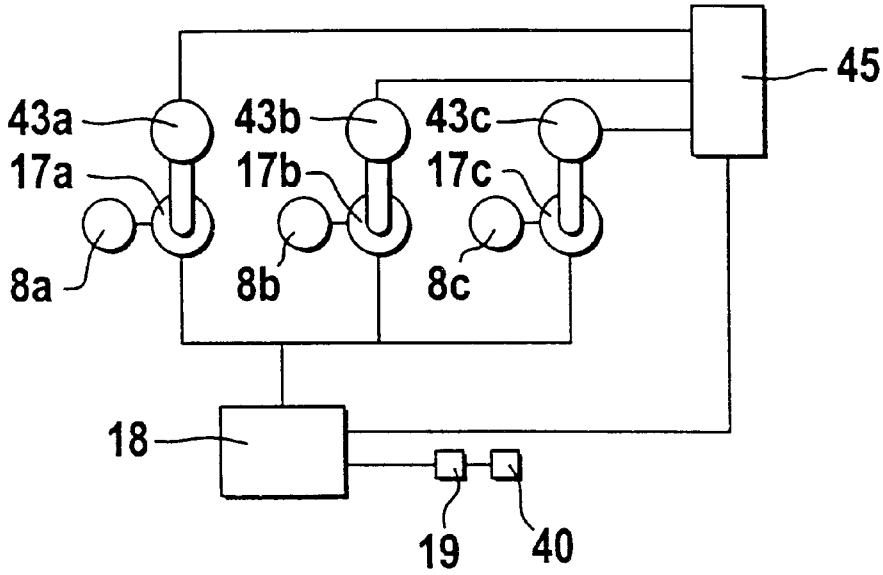
Fig. 6
Fig. 7a
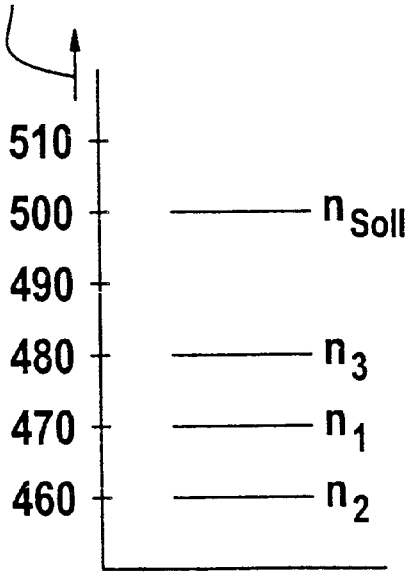
Fig. 7b
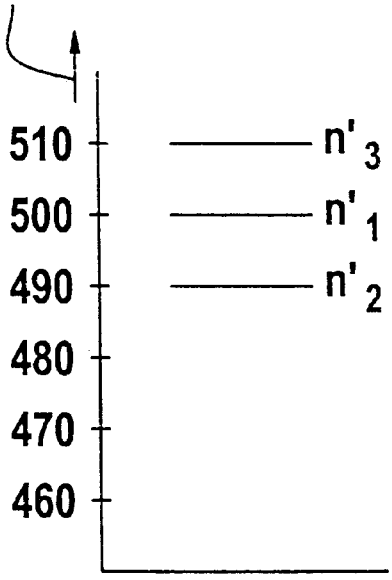

APPARATUS FOR INTRODUCING SLIVER INTO A TEXTILE PROCESSING MACHINE

CROSS REFERENCE TO RELATED APPLICATION

This application is a continuation of pending United States patent application Ser. No. 09/775,810 filed Feb. 5, 2001.

This application claims the priority of German Application No. 100 04 604.5 filed Feb. 3, 2000, which is incorporated herein by reference.

BACKGROUND OF THE INVENTION

This invention relates to an apparatus for introducing slivers into a fiber processing machine, particularly a regulated draw frame. The slivers are withdrawn from a plurality of coiler cans by means of driven supply rolls mounted on a creel. The slivers are introduced into a driven draw unit of the draw frame. At least two electric drive motors are provided, whose rpm may be set.

An apparatus of the above-outlined type is described, for example, in German Patent No. 198 09 875 to which corresponds U.S. Pat. No. 6,170,125.

A separate, rpm-controlled drive motor is associated with each supply roll mounted on the creel of draw frame, thus permitting an individual setting of the circumferential speed of the supply rolls.

SUMMARY OF THE INVENTION

It is an object of the invention to provide an improved apparatus of the above-outlined type with which load-dependent rpm deviations may be eliminated or compensated for in a simple manner.

This object and others to become apparent as the specification progresses, are accomplished by the invention, according to which, briefly stated, the apparatus for introducing a plurality of slivers simultaneously to a sliver processing machine includes an arrangement for withdrawing the slivers from coiler cans; a creel; a plurality of supply rolls mounted on the creel and contacting the slivers; a drive, having at least one drive motor, for rotating each supply roll; a common converter connected to the drive; and an rpm setter for setting rpm's of the drive such that the drive has an rpm essentially corresponding to a desired rpm.

While three-phase motors, because of slippage, have a load-dependent rpm characteristic, according to the invention the risks of a defective drawing process arising from such slippage is avoided. The slivers, within the creel, must not have impermissible deviations from their intake tension either with respect to one another or with respect to the unlike distances between the supply rolls and the intake roll pair mounted in the after-connected draw unit. According to the invention, despite the loads imposed on the motors, a desired rpm thereof may be fully or substantially fully achieved whereby a defective drawing of the slivers is avoided. As the driving force of the supply rolls is transferred to the slivers, material-specific frictional differences are also compensated for. While in practice the frictional force decreases from cotton (which may contain adhesive substances) through cotton/chemical fiber mixtures to pure chemical fibers (which have a smooth upper surface), by virtue of the invention, independently from the type of fiber material, a reliable and effective transfer of the driving force to the slivers is achieved. It is a particular advantage of the invention that the apparatus is inexpensive to manufacture and install.

The invention has the following additional advantageous features:

At least two drive motors are associated with the supply rolls of the draw frame creel.

With each supply roll a separate drive motor is associated.

At least one drive motor for the supply rolls and at least one drive motor for the roll pairs of the draw unit in the preliminary drafting field are provided.

The drive motor is a frequency-controlled three-phase synchronous motor or asynchronous motor. In a three-phase synchronous motor no rpm deviations are present.

The drive motor is a reluctance motor which, during acceleration, behaves like a three-phase asynchronous motor and, during normal operation, behaves like a synchronous motor so that no rpm correction is required.

The drive motor is a current rectifier-controlled direct current motor and, in such a case, the current supplying converter generates an rpm-proportional voltage.

The drive motor is a gear motor.

The drive motor is an inner rotor-type motor or an outer rotor-type motor.

The current supplying converter supplies an rpm-setting voltage of variable amplitude and frequency.

The converter is a frequency converter or a d.c. current rectifier.

The converter has a desired value transmitter such as a potentiometer operated by a control device.

An rpm transmitter, for example, a tachogenerator is provided.

If several tachogenerators are present, a mean value former is provided to which the tachogenerators are connected.

One of the drive motors or rolls, for example, a supply roll, is provided with an rpm-proportional transmitter. Such a drive motor or roll represents all the drive motors or rolls.

The rpm-proportional transmitter is connected with the converter and affects the output voltage and/or frequency of the converter such that the deviations from a desired value are maintained low.

More than one actual rpm value transmitter is provided to determine an average actual rpm of a plurality of rolls and/or drive motors. The calculated average rpm deviation affects the frequency and/or the output voltage of the current-supplying converter.

The drive motor is a direct current motor and the current-supplying converter generates an rpm-proportionate voltage which is additionally regulated by an actual rpm transmitter.

The desired rpm is formed such that it is proportional to the rpm of the input roll of the draw unit.

Drive motors having identical rpm characteristics are used for driving the supply rolls.

The rpm's of the drive motors for the supply rolls are at least approximately identical, and means are provided for rendering the circumferential speeds of the supply rolls different from one another.

The drive motors are unregulated asynchronous motors or direct current motors supplied with current from a joint converter, and the rpm's may be jointly set.

BRIEF DESCRIPTION OF THE DRAWINGS

FIG. 2 is a top plan view of the construction shown in FIG. 1 using outer rotor-type drive motors.

FIG. 3 is a schematic top plan view of a draw frame illustrating a further embodiment of the invention in which one drive motor is associated with the supply rolls and one drive motor is associated with a sliver drawing roll pair which serves the preliminary draw field.

FIG. 6 is a block diagram of a control system for the drive motors of the supply rolls, including a separate tachogenerator for each supply roll, an average value forming device and a joint converter.

FIGS. 7*a* and 7*b* are diagrams showing an rpm control system for three load-dependent asynchronous motors for the supply rolls.

DESCRIPTION OF THE PREFERRED EMBODIMENTS

Figure 1:
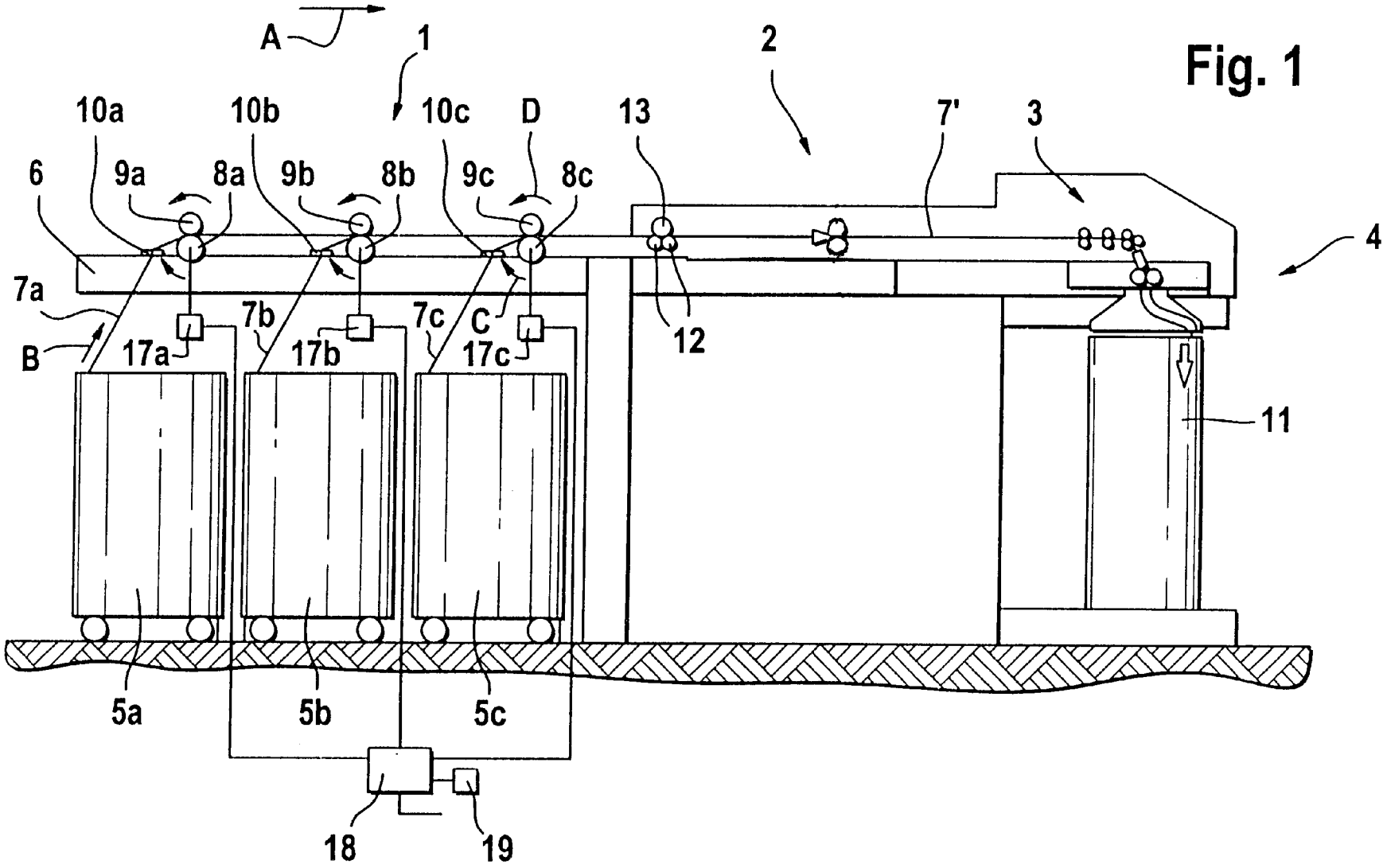
FIG. 1 is a schematic side elevational view of a draw frame incorporating a preferred embodiment of the invention wherein an inner rotor-type drive motor is associated with each supply roll on the creel.

FIG. 1 shows the inlet region 1, the measuring region 2, a draw unit 3 and a sliver coiler system 4 of a draw frame which may be an HSR Model, manufactured by Trutzschler GmbH & Co. KG, Monchengladbach, Germany. In the inlet region 1 three round coiler cans 5*a*, 5*b* and 5*c* are visible which are positioned underneath a creel 6. The slivers 7*a*, 7*b* and 7*c* are withdrawn from the respective coiler cans over supply rolls 8*a*, 8*b* and 8*c* and are advanced to the draw unit 3. With each driven supply roll 8*a*, 8*b* and 8*c*, a respective upper roll 9*a*, 9*b* and 9*c* is associated and is driven by friction from the lower, supply roll. The slivers 7*a*–7*c* are crushed between the respective roll pairs. After passing through the draw unit 3, the drawn sliver is introduced into a coiler disk of a sliver coiling device and is deposited in loops into an output coiler can 11.

In the region of each lower roll 8*a*–8*c* a respective guiding device 10*a*–10*c* is provided for guiding the respective slivers 7*a*–7*c* moving from the respective coiler cans in the direction B. The running direction of the slivers from the supply rolls in the direction of the draw unit is designated at A.

As the slivers 7*a*–7*c* are pulled from the respective coiler cans 5*a*–5*c*, they balloon and swing above the coiler cans 5 (particularly when they advance at high speed) and become quieted after passing the respective supply rolls 8*a*–8*c*. The direction of rotation of the supply rolls 8*a*–8*c* and the upper rolls 9*a*–9*c* is indicated by the respective curved arrows C, D in FIG. 1.

Downstream of the creel 6 as viewed in the direction of sliver advance, that is, at the inlet of the draw frame, a driven roll assembly is arranged which is composed, for example, for each sliver, of two lower rider rolls 12 and an upper rider roll 13.

Each supply roll 8 is driven by its own drive motor 17*a*–17*f* which is an inner rotor-type motor, that is, a frequency-controlled three-phase asynchronous motor. The drive motors 17*a*–17*f* are all connected to a common converter 18, for example, a frequency converter which includes a desired value setter 19. The supply rolls 8*a*–8*c* have the same diameter, for example, 100 mm. The rpm's of the motors 17*a*, 17*b* and 17*c* decrease in the working direction A, and the same applies to the drive motors 17*d*, 17*e* and 17*f* (FIG. 2). Accordingly, the circumferential speed of the supply rolls also decreases in the working direction A. Thus, the circumferential speeds of the various support rolls may be set such that the intake tension of all the slivers 7 is at least approximately equal, as desired. In the alternative, all drive motors 17*a*–17*f* may have the same rpm, resulting in an economical embodiment. To achieve, in such a case, a decreasing circumferential speed of the supply rolls 8*a*–8*f* in the working direction, the outer diameter of the supply rolls is different.

As shown in FIG. 2, on each side of the creel 6 a separate row of parallel oriented coiler cans 5*a*–5*c* and, respectively 5*d*–5*f* are arranged. During operation, either the six coiler cans are simultaneously operative, that is, a sliver is simultaneously withdrawn from each of the six coiler cans or at any time sliver is supplied from only one row, for example, from the row of coiler cans 5*a*–5*c*, whereas, at the same time, the coiler cans 5*d*–5*f* of the other row are being replaced. Further, on each side of the creel 6 supply rolls 8*a*–8*c* and, respectively, 8*d*–8*f* are provided. The supply rolls are arranged in pairs wherein within each pair the two supply rolls are coaxial with one another. The supply rolls 8*a*–8*f* are each driven by their own rpm controlled electromotor 17*a*–17*f* which are connected to a joint control and regulating device 40 (FIG. 4), such as a microcomputer. As shown in FIG. 2, the drive motors 17*a*–17*f* are outer rotor-type motors connected to a common converter 18. Expediently, the drive motors 17*a*–17*f* have the same rpm and, as noted above, to ensure a decreasing circumferential speed of the supply rolls in the working direction A, the outer diameter of the supply rolls 8*a*–8*f* is different. In the alternative, the supply rolls 8*a*–8*f* have the same diameter and the drive motors have different rpm's.

As shown in FIG. 3, eight supply rolls 8 are provided, each handling sliver from a separate, non-illustrated coiler can. All the supply rolls 8 are driven by a common drive motor 17, for example, a three-phase synchronous motor and between the supply rolls 8 and the drive motor 17 non-illustrated mechanical transmission elements such as drive belts, gears, a gearing or the like are provided.

In the draw unit 3 lower draw rolls III and II of the roll pair III/28 and II/27 for the preliminary draw field are driven by an rpm-controlled drive motor 20. The motors 17 and 20 are connected to the converter 18 and are supplied by electric current therefrom.

Figure 4:
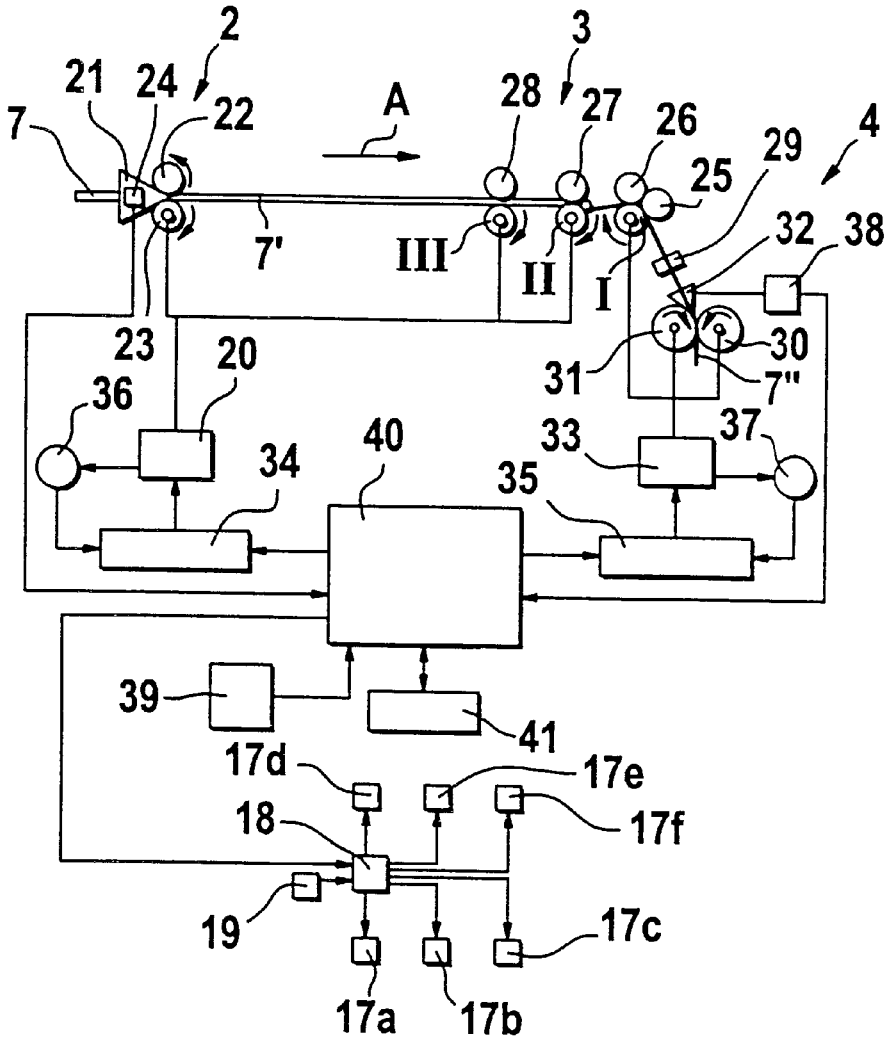
FIG. 4 is a schematic side elevational view, with block diagram, of the regulated draw frame of FIG. 1.

FIG. 4 illustrates a draw-frame which may be, for example, an HSR model manufactured by Trützschler GmbH & Co. KG, Mönchengladbach, Germany. The draw frame includes a draw unit 3 which is preceded by a draw unit inlet 2 and followed by a draw unit outlet 4. The slivers, withdrawn from the coiler cans, enter a sliver guide 21 and, pulled by withdrawing rolls 22, 23 are further advanced past a measuring member 24. The draw unit 3 is a 4-over-3 construction, that is, it has three lower rolls I, II, III (namely, a lower output roll I, a lower mid roll II and a lower input roll III) and four upper rolls 25, 26, 27 and 28. In the draw unit 3 the drawing of the sliver bundle formed of several slivers is performed. The draw field is composed of a preliminary draw field and a principal draw field. The roll pairs 28/III and 27/II form the preliminary draw field whereas the roll pairs 27/II and the roll assembly 25, 26/I form the principal draw field. The drawn slivers reach a sliver guide 29 in the draw unit outlet 4 and are, by means of withdrawing rolls 30, 31 pulled into a sliver trumpet 32 where the slivers are combined into a single sliver 7" which is subsequently deposited into a coiler can 11 (shown in FIG. 1).

The withdrawing rolls 22, 23, the lower input roll Be III and the lower mid roll II which are mechanically interconnected, for example, by toothed belts, are driven by the regulating motor 20, while a desired rpm value is inputted. The upper rolls 27 and 28 are driven by friction by the respective lower rolls II, III. The regulating motor 20 and the principal motor 33 each are connected to a respective regulator 34, 35. The rpm regulation occurs by means of a closed regulating circuit in which the regulator 33 is connected to a tachogenerator 36 and the principal motor 33 is connected to a tachogenerator 37.

At the draw unit inlet 2 a mass-proportional magnitude of the sliver (for example, its cross section) is measured by means of the input measuring member 24 which is described, for example in German patent document 44 04 326. At the draw unit outlet 4 the cross section of the exiting sliver 7" is obtained from an output measuring member 38 which is integrated in a sliver trumpet 32 and which is known, for example, from German patent document 195 37 983. A central computer unit 40 (control and regulating device), for example, a microcomputer with microprocessor, transmits a setting of the desired magnitude for the regulating motor 20 to the regulator 34. The measuring magnitudes of the two measuring members 24 and 38 are transmitted during the drawing operation to the central computer unit 40. The central computer unit 40 determines the desired value for the regulating motor 20 from the measuring magnitudes of the intake measuring member 24 and from the desired value for the cross section of the exiting sliver 7". The measuring magnitudes of the output measuring member 38 serve for monitoring the exiting sliver 7". With the aid of such a regulating system cross-sectional fluctuations of the inputted sliver may be compensated for by suitable regulation of the sliver drawing process. An evening of the sliver 7– may be achieved according to the measures of the invention by providing that already in the region of the creel 6 erroneous drafting steps of the slivers are reduced or avoided altogether. The central computer unit 40 of the fiber processing machine is connected with a memory 39 in which signals of the control and regulating system may be stored for evaluation. Further, to the computer unit 40 a function former 41, for example, a peak converter, computer, or the like is connected which in turn is coupled to the converter 18 serving the rpm-controlled electric motors 17*a*–17*f*. The rpm of the electric motors 17*a*–17*f* may be set based on the desired values pre-stored in the memory 39 for the desired value setter 19. By means of the joint converter 18 the rpm of the drive motors 17 and 20 is simultaneously changed upon changing of the feed, for example, during start-up or braking of the machine or in case of a change during normal operational run. The relatively small rpm change of the drive motor 20 serves for a thickness correction of the sliver 7' and is additionally performed. According to FIG. 5, three drive motors 17*a*, 17*b* and 17*c* are provided for the respective supply rolls 8*a*, 8*b* and 8*c*. The supply roll 8*c*, representing all the supply rolls, is, by means of a shaft 14, connected with a tachogenerator 43 functioning as an rpm-proportional transmitter. The tachogenerator 43, in turn, is connected with the frequency converter 18 having a desired value inputter 19. The frequency converter 18 applies its signals to the drive motors 17*a*, 17*b*, 17*c*. Based on an actual rpm inputted into the frequency converter 18, The tachogenerator 43 affects the outlet voltage and frequency of the frequency converter 18 (current supply converter) to maintain as small as possible a deviation of the rpm's of the drive motors 17*a*–17*c* from a desired rpm which is inputted by the rpm setter 19.

Turning to FIG. 6, to each drive motor 17*a*, 17*b* and 17*c*, which may be frequency-controlled asychronous motors (three-phase motors), a respective tachogenerator 43*a*, 43*b* and 43*c* is connected which, in turn, apply their signals to a common mean value-forming device 45 connected to the frequency converter 18 which is coupled to the drive motors 17*a*–17*c*. The frequency converter 18 has a desired value setter 19 for the desired rpm which is connected to the control and regulating device 40. The desired rpm value is formed to be proportional to the rpm of the draw unit input roll III (FIG. 4). A mean actual rpm value is determined for the supply rolls 8*a*–8*c* by means of the plurality of tachogenerators 43*a*–43*c* (actual rpm value transmitters) and the mean value forming device 45. The computed mean rpm deviation affects the frequency and/or output voltage of the converter 18.

FIGS. 7*a* and 7*b* show in an exemplary manner the mode of operation of the embodiment according to FIG. 6. According to FIG. 7*a*, the actual rpm values, measured by the tachogenerators 43*a*–43*c* are as follows: $n_1$=470 rpm for the motor 17*a*; $n_2$=460 rpm for the motor 17*b*; and $n_3$=480 rpm for the supply roll 17c. The three-phase asynchronous motors 17*a*–17*c* change their respective rpm $n_1$, $n_2$ and $n_3$ in a load-dependent manner. Such a deviation from the desired rpm is designated as slippage. A mean rpm=470 is calculated from the actual rpm's $n_1$, $n_2$ and $n_3$ by means of the mean value forming device 45 and compared in the converter 18 with the desired rpm=500. The output voltage and/or frequency is accordingly adapted and applied to the drive motors 17*a*, 17*b* and 17*c* which, in this manner, assume new actual rpm values as follows: $n'_1$=500 rpm for the motor 17*a*, $n'_2$=490 rpm for the motor 17*b* and $n'_3$=510 rpm for the motor 17*c*. The level of the actual rpm's has been shifted jointly from n to n'. The new actual rpm's $n'_2$ and $n'_3$ have only a small deviation from the desired rpm value and the actual rpm $n'_1$ equals the desired rpm value. In this manner the load dependency is compensated for to a large extent, that is, almost entirely, in a simple manner.

It is feasible to use synchronous motors which do not need tachogenerators. A regulation is not necessary because three-phase synchronous motors have no slippage. All drive motors 17*a*–17*c* are during operation set by the converter 18 for a desired rpm, for example, at 500 rpm by means of the desired value setter 19.

Figure 5:
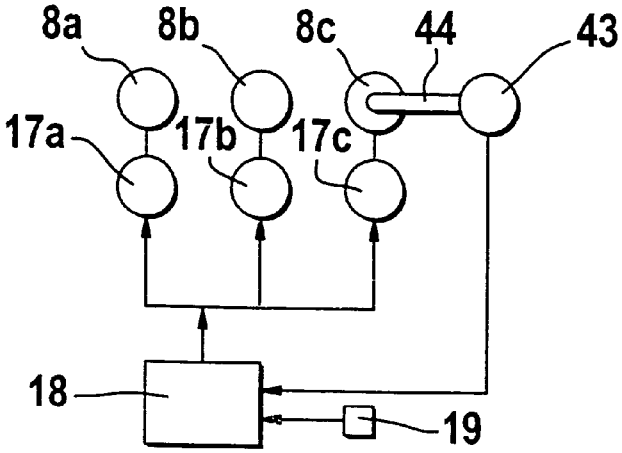
FIG. 5 is a block diagram of a control system for the drive motors of the supply rolls, including a tachogenerator connected to one of the supply and a joint converter.

In case direct current motors are used as drive motors, a regulation is required, similarly to FIGS. 5 and 6, to essentially compensate for the load dependency.

According to the invention, load-dependent rpm deviations are compensated for in a simple manner, the drive motors are supplied with current by a common converter and the rpm's are jointly settable whereby a load-independent rpm for the drive motors may be obtained.

It will be understood that the above description of the present invention is susceptible to various modifications, changes and adaptations, and the same are intended to be comprehended within the meaning and range of equivalents of the appended claims.

What is claimed is:

1. Apparatus for introducing a plurality of slivers simultaneously to a sliver processing machine, comprising (a) means for withdrawing the slivers from coiler cans; said means for withdrawing including (1) a creel; and (2) a plurality of supply rolls mounted on said creel and contacting the slivers;

(b) drive means for rotating each said supply roll; said drive means comprising at least one drive motor;

(c) a common converter connected to said drive means; and (d) setting means for setting rpm's of said drive means to essentially correspond to a desired rpm.

2. The apparatus as defined in claim 1, further comprising an rpm sensor connected to one of said supply rolls and to said converter for applying an rpm value of said one supply roll to said converter.

3. The apparatus as defined in claim 1, wherein said converter comprises means for producing an rpm-proportional voltage; and further comprising an actual-rpm sensor connected to said at least one drive motor and said supply roll and connected to said converter for regulating the rpm-proportional voltage as a function of said actual rpm.

4. The apparatus as defined in claim 1, wherein said converter comprises means for producing an rpm-determining voltage of one of variable magnitude and variable frequency.

5. The apparatus as defined in claim 1, wherein said converter is a frequency converter.

6. The apparatus as defined in claim 1, wherein said converter is a direct current rectifier.

7. The apparatus as defined in claim 1, further comprising a desired value inputter connected to said converter and a control device connected to the inputter for determining a desired rpm magnitude therein.

8. The apparatus as defined in claim 1, further comprising an rpm sensor connected to said drive motor and to said converter for applying an rpm value of said drive motor to said converter.

9. The apparatus as defined in claim 1, in combination with a draw frame including a plurality of draw roll pairs; said draw frame constituting said sliver processing machine; said drive means further comprising an additional motor for driving one of said draw roll pairs.

10. The apparatus as defined in claim 9, further comprising means for generating the desired rpm value proportional to an rpm of said additional motor.

11. The apparatus as defined in claim 1, wherein said drive means comprises a plurality of drive motors, each driving a separate one of said supply rolls.

12. The apparatus as defined in claim 11, further comprising means for providing for different circumferential speeds for said supply rolls.

13. The apparatus as defined in claim 11, further comprising a plurality of rpm sensors connected to at least some of said drive motors for emitting signals representing the rpm of respective said drive motors; and a mean value forming device connected to said rpm sensors for receiving said signals from said rpm sensors to produce a mean rpm value.

14. The apparatus as defined in claim 13, wherein said mean value forming device is connected to said converter for applying said mean rpm value to said converter.

15. Apparatus for introducing a plurality of slivers simultaneously to a sliver processing machine, comprising (a) means for withdrawing the slivers from coiler cans; said means for withdrawing including
  (1) a creel; and
  (2) a plurality of supply rolls mounted on said creel and contacting the slivers;

(b) drive means for rotating each said supply roll; said drive means comprising at least two unregulated asynchronous drive motors;

(c) a common converter connected to said drive motors; and (d) setting means for jointly setting rpm's of said drive motors.

16. Apparatus for introducing a plurality of slivers simultaneously to a sliver processing machine, comprising (a) means for withdrawing the slivers from coiler cans; said means for withdrawing including
  (1) a creel; and
  (2) a plurality of supply rolls mounted on said creel and contacting the slivers;

(b) drive means for rotating each said supply roll; said drive means comprising at least two unregulated direct current drive motors;

(c) a common converter connected to said drive motors; and (d) setting means for jointly setting rpm's of said drive motors.

* * * * *